US006571579B1

(12) United States Patent
Rissin

(10) Patent No.: US 6,571,579 B1
(45) Date of Patent: Jun. 3, 2003

(54) EARRING STABILIZER

(75) Inventor: Joseph B. Rissin, Baldwin, NY (US)

(73) Assignee: Rissin's Solutions, LLC., Baldwin, NY (US)

( * ) Notice: Subject to any disclaimer, the term of this patent is extended or adjusted under 35 U.S.C. 154(b) by 0 days.

(21) Appl. No.: 09/545,301

(22) Filed: Apr. 7, 2000

(65) Prior Publication Data

(65)

(51) Int. Cl.[7] ..... A44C 25/00

(52) U.S. Cl. ..... 63/33; 63/12; 63/13; 63/14.1

(58) Field of Search ..... 63/12, 13, 14.1, 63/14.3, 14.4, 14.5, 14.6, 14.7, 33

(56) References Cited

U.S. PATENT DOCUMENTS

| | | | | | |
|---|---|---|---|---|---|
| 2,490,908 | A | * | 12/1949 | Kohler | 63/14.7 |
| 2,947,054 | A | * | 8/1960 | Adams | 24/518 |
| 3,037,367 | A | * | 6/1962 | Ebertin | 63/20 |
| 3,595,031 | A | * | 7/1971 | Weimer | 63/14.5 |
| 3,630,048 | A | | 12/1971 | Masters | |
| 3,890,800 | A | | 6/1975 | Montague | |
| 3,975,921 | A | | 8/1976 | Pomaski | |
| 4,003,216 | A | | 1/1977 | Cecere et al. | |
| 4,214,456 | A | | 7/1980 | Hannum | |
| 4,655,055 | A | | 4/1987 | Moody | |
| 4,688,400 | A | | 8/1987 | Chioffe | |
| 5,044,176 | A | | 9/1991 | King | |
| 5,161,391 | A | * | 11/1992 | Lorberfeld | 63/13 |
| 5,181,397 | A | | 1/1993 | Battista | |
| 5,337,584 | A | * | 8/1994 | Angeli | 63/1.17 |
| 5,513,502 | A | | 5/1996 | Seaton, Jr. | |
| 5,537,842 | A | | 7/1996 | Battista | |
| 5,588,309 | A | * | 12/1996 | Chioffe | 63/12 |
| 5,906,114 | A | | 5/1999 | Rissin | |

* cited by examiner

*Primary Examiner*—James R. Brittain
*Assistant Examiner*—Andrea Chop
(74) *Attorney, Agent, or Firm*—Stephen E. Feldman

(57) ABSTRACT

An improved earring stabilizer that provides additional support, improved stability and added comfort to a wearer of earrings. The earring stabilizer is used to contact an earring wearer's ear and prevent the earrings from sagging on the ear of the wearer. More particularly, the earring stabilizer of the present invention consist of two extension bars and an earring stabilizer that may be cast, stamped, wire formed or manufactured to be a single, uniform article. Alternatively, the earring stabilizer may be secured to an earring retaining means through the use of a mount, by solder, or other attachment means.

20 Claims, 4 Drawing Sheets

EARRING STABILIZER

FIELD OF THE INVENTION

The invention relates to the field of jewelry, specifically an improved earring stabilizer that provides additional support, improved stability and added comfort to a wearer of heavy earrings. More particularly, the earring stabilizer of the present invention consist of two extension bars and an earring stabilizer that may be cast, stamped, wire formed or manufactured to be a single, uniform article. The earring stabilizer may have a mount for securing it to an earring retaining means.

BACKGROUND OF THE INVENTION

There is a variety of well known apparatus and methods for stabilizing and securing earrings to an ear. However, these methods and apparatus present several problems. There is a long felt need for a more effective method and apparatus for securing and stabilizing an earring to a wearer's ear.

Earrings are commonly secured to a person's ear through the use of an earring retaining means, such as an earring nut (also known as a clutch), a hinged clip (also known as clip-on or omega back), and other similar means. The use of these earring retaining means is well known in the field of jewelry.

Where an earring nut is utilized, an earring having a post is inserted into and extended through a pierced hole in the wearer's ear. An earring nut generally has an opening capable of engaging the post of the earring so that the earring may be secured to a wearer's ear. The earring nut and post may also be threaded so that they may be screwed together. This is often used as a means to prevent an earring nut from falling off of a post.

Where a hinged clip is utilized, it generally has an elongated member that pivots on a hinge. This allows the clip to move between an open and closed position. The hinged clip relies on spring action in the elongated member to move and remain in an open or closed position. As the length of the elongated member increases, the spring action decreases. Therefore, the elongated member should be a sufficient length capable of maintaining the spring action. The elongated member may be bent into different shapes to maintain this springing action. When in a closed position, the elongated clip compresses the earring to a wearer's ear. The earring may also have a post (in the case of an omega back) capable of penetrating a wearer's ear. In this case, hinged clip should have an opening that allows the post to penetrate through the elongated member.

While these retaining means are effective for securing an earring to a wearer's ear, they do not address the particular need to prevent heavy or large earrings from sagging on a wearer's ear. Heavy earrings tend to sag on a wearer's car, and therefore, cause pain and discomfort to a wearer. Furthermore, a sagging earring is not aesthetically pleasing. As a result, many people may be reluctant to wear heavy earrings. Several inventions attempt to address these problems.

U.S. Pat. No. 5,906,114 to Rissin discloses an earring stabilizer having an earring retaining means, a single extension bar, and mount.

U.S. Pat. No. 4,688,400 to Chioffe discloses a earring back device having a back clutch movably attached to a bridge mechanism whose ends are inserted into an ornament holder. The device of Chioffe is used to allow an earring wearer to adjust the distance between the back clutch and the ornament holder, so that a wearer may place the ornament holder in a desired position at the base of her ear lobe.

There is a long felt need for an improved earring stabilizer that prevents sagging of heavy earrings and provides improved support to such earring. The present invention seeks to solve this long felt need.

SUMMARY OF THE INVENTION

The present invention provides a stabilizer for earrings, and is especially suited for earrings worn on pierced and non-pierced ears, such as a hinged clip, earring nut or other earring retaining means. The stabilizer comprises two elongated bars and a stabilizing member. In another embodiment, the elongated bars are omitted. The earring retaining means may be cast, stamped, wire formed or manufactured to include the earring stabilizer as a single, uniform article. The earring stabilizer may be attached to an earring retaining means through conventional methods, including soldering, a mount and other means.

It is an object of the present invention to provide an improved stabilizer for earrings.

It is an object of the present invention to provide additional support for earrings through the use of two supporting struts for improved stability and comfort.

It is another object of the present invention to implement an improved method of attachment of an earring stabilizer to an earring.

It is another object of the present invention to provide an earring stabilizer without extension bars.

It is another object of the present invention to provide an earring stabilizer that may be attached to an earring without the use of a mount.

Other objects will become apparent from the foregoing description.

BRIEF DESCRIPTION OF THE DRAWINGS

The following description of preferred embodiments of the present invention will be better understood when read in conjunction with the appended drawings. It should be understood, however, that the invention is not limited to the precise arrangements shown in which.

DESCRIPTION OF THE PREFERRED EMBODIMENT

The present method and apparatus is of broad applicability to many technical fields for the production of an infinite variety of articles. More particularly, the present invention relates to an earrings stabilizer for balancing and supporting heavy earrings.

Figure 1:
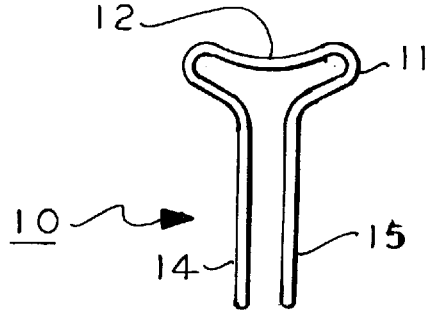
FIG. 1 is a front view of the earring stabilizer of the present invention.
Figure 2:
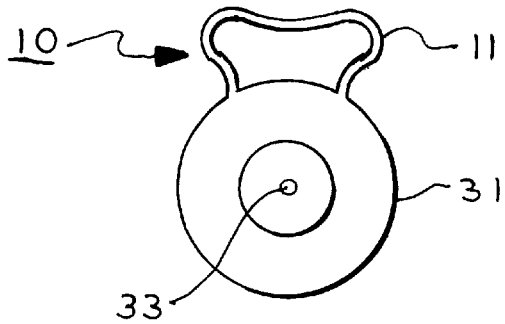
FIG. 2 is a front view of an earring stabilizer having only a stabilizing member attached to an earring nut.

Referring to FIG. 1, the earring stabilizer 10 of the present invention may be cast, stamped, wire formed or manufactured as a single, uniform article allowing for easy and secure attachment to an, earring retaining means. In a preferred embodiment, an earring stabilizer 10 has a loop shaped stabilizing member 11 with extension bars 14 and 15 extending downwardly from the bottom end of the stabilizing member 11. The earring stabilizer 10 should have a uniform, round diameter throughout. It should be noted, however, that where the stabilizer 10 is stamped, the stabilizer should be half-round. The dimensions of the stabilizer 10, however, should be uniform throughout. The extension bars 14 and 15 should be capable of attachment to an earring retaining means, including but not limited to, an earring nut, a hinged earring clip, and other similar types of earring retaining means. The earring stabilizer 10 may be cast, stamped, wire formed or manufactured to include a mount 13 (discussed herein). In another embodiment, earring stabilizer 10 consists of stabilizing member 11 wherein extension bars 14 and 15 are not utilized. In this embodiment, the earring retaining means may be cast, stamped, wire formed or manufactured to include stabilizing member 11, as shown in FIG. 2. Alternatively, stabilizing member 11 may be attached to an earring retaining means through the use of mount 13.

Having described the general components of the earring stabilizer 10, the size and dimension of these components are discussed below.

Extension bars 14 and 15 provide stability and strength to the stabilizer. Extension bars 14 and 15 should be substantially parallel to each other and be sufficiently spaced apart to be securely fixed to an earring retaining means. Since earring retaining means may vary in kind, size and shape, extension bars 14 and 15 may be adjusted from their parallel position to suit the different types of retaining means. Therefore, the spacing of extension bars 14 and 15 may vary according to the dimensions of the retaining means and stabilizing member 11. Furthermore, the length of extension bars 14 and 15 may vary according a size and shape of the wearer's ear and earring to be worn. In one embodiment, the length of the extension bars 14 and 15 is approximately ⅛ of an inch.

Figure 3:
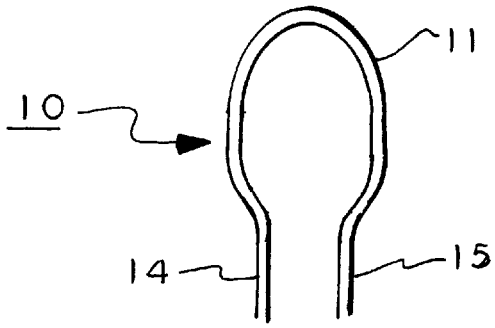
FIG. 3 is a front view of the a u-shape earring stabilizer of the present invention.

The stabilizing member 11 bears a substantial portion of the weight of the earring it is stabilizing. Therefore, the size (width and height) and shape of the stabilizing member 11 may vary according to the size and weight of the earring. Where the extension bars are ⅛ of an inch, the width of the stabilizing member is approximately ⅜ of an inch. As the weight of the earring increases, the height of the stabilizing member 11 should also increase. While the width of the stabilizing member 11 may vary, it should nevertheless be less than the width of the wearer's ear. The shape of the stabilizing member 11 may also vary according to several factors, including, weight and size of the earring. Referring to FIG. 1, the top end of the stabilizing member 11 may have a concave edge 12 capable of comfortably and securely engaging a wearer's ear. Referring to FIG. 3, a u-shaped stabilizing member 11 is utilized for stabilizing extraordinarily large or heavy earrings. It should be noted, however, that the stabilizing member 11 may consist of other sizes and shapes, including, but not limited to, a square, a circle, a flat disc, a sphere, animal shapes (for children), or any other shape capable of comfortably and securely stabilizing heavy earrings.

Finally, stabilizing member 11 and extension bars 14 and 15 should have a uniform thickness and/or diameter throughout. This provides for better stability and strength in the earring stabilizer 10.

Having described the size and dimensions of the components of the earring stabilizer 10, the method of attaching the earring stabilizer 10 to an earring retaining means is described below.

The earring stabilizer 10 should be capable of attachment to an earring retaining means. An earring retaining means may be an earring nut 31, a hinged clip 41 or any other article capable of securing an earring to a wearer's ear.

Figure 4:
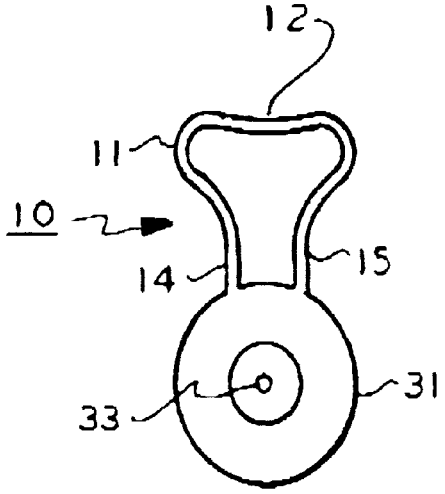
FIG. 4 is a front view of an earring nut cast, stamped, wire formed or manufactured to include the earring stabilizer of the present invention.
Figure 5:
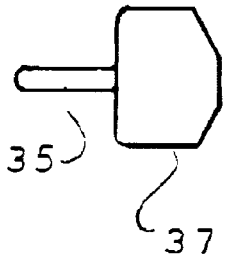
FIG. 5 is a side view of an earring having a post.

Referring to FIGS. 4 and 5, earring stabilizer 10 is attached to an earring nut 31. The earring nut 31 should have an opening 33 capable of engaging an earring post 35 of earring 37. The earring nut 31 should be manufactured to include the earring stabilizer 10 as a single, uniform article that includes the stabilizing member 11 and extension bars 14 and 15.

Figure 6:
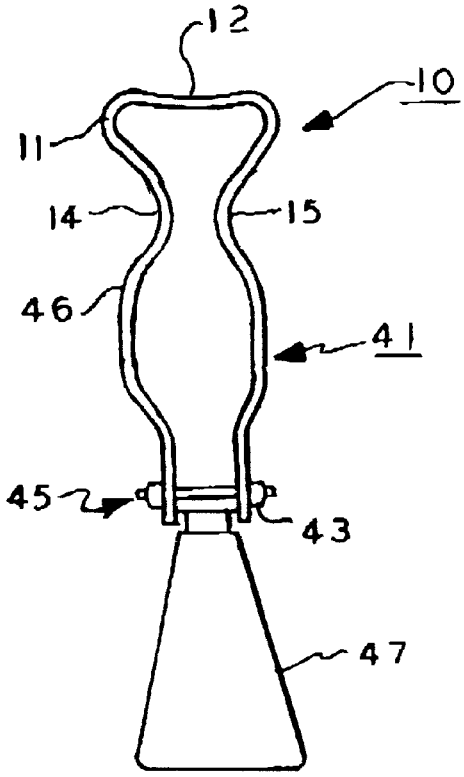
FIG. 6 is a front view of a hinged clip cast and manufactured to include the earring stabilizer of the present invention.
Figure 7:
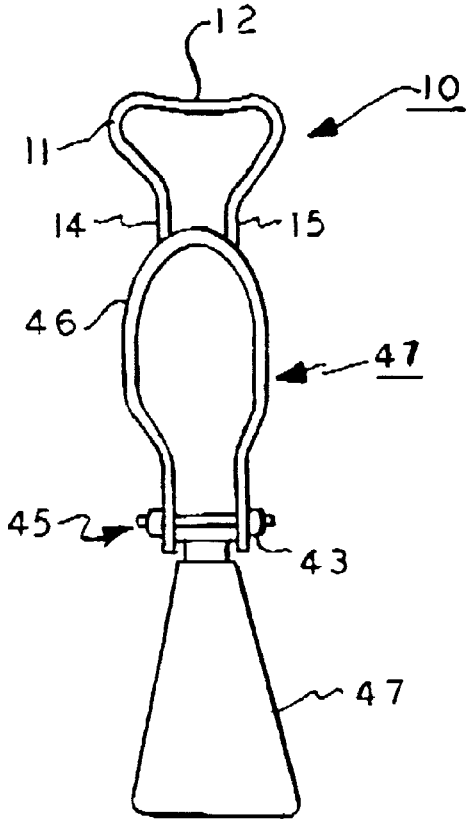
FIG. 7 is a front view of the an earring stabilizer attached to a hinged clip earring using the attachment means (such as soldering) described herein.
Figure 8:
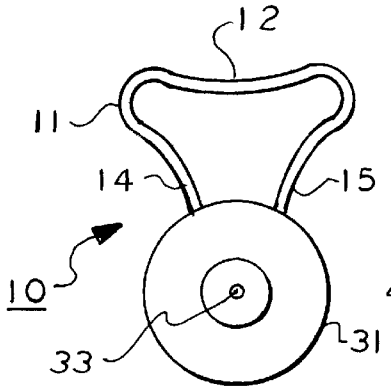
FIG. 8 is a front view of the an earring stabilizer attached to an earring nut using the attachment means (such as soldering) described herein.

Referring to FIG. 6, earring stabilizer 10 is attached to a hinged earring clip 41 (also known as "clip on" or omega back). Hinged clips 41 are well known and should have a hinge 43, pin 45 and elongated member 46. It should be noted that a rivet may be used in place of pin 45. Elongated member 47 may have different shapes, such as a loop, omega, rectangle and other shapes. Elongated 47 member should be of a sufficient length to provide spring action in hinged clip 41. As a result, hinged clip 41 will be capable of moving between an open and closed position so that an earring may be removed from or secured to an wearer's ear. As shown in FIG. 6, the hinged earring clip 41 should be cast, stamped, wire formed or manufactured to include the earring stabilizer 10 as a single, uniform article that includes stabilizing member 11 and extension bars 14 and 15. In this case, extension bars 14 and 15 are used in place of elongated member 46. Extension bars 14 and 15 should be of a sufficient length to maintain the required spring action for opening and closing. Similarly, extension bars 14 and 15 should be of a sufficient length to provide a point of contact on a wearer's ear so that the stabilizer 10 will prevent an earring from sagging. It should be noted, however, that the length of the extension bars 14 and 15 will vary according to the size of the earring and the wearer's ear. For example, where a earring having a single one-fourth of an inch (¼") diamond, the length of extension bars 14 and 15 may vary between one-half of an inch (½") to one and one half on an inch (1½"). For larger earrings, such as one half of an inch (½") and one and one half inch, extension bars 14 and 15 may vary between one-half of an inch (½") to two inches (2"). The earring stabilizer 10 should be attached to earring 47 through the use of a hinge 43 and pin 45. Hinge 43 and extension bars 14 and 15 should have openings capable of engaging pin 45. The stabilizer 10 is placed in hinge 43 with all of the openings aligned. Thereafter, pin 45 should be inserted into the openings of hinge 43 and extension bars 14 and 15. To prevent pin 45 from becoming loose, pin 45 should have a closing means (such as a soldered rivet, melting ends of rivets or other closing means) capable of securing the pin in the hinge.

Figure 9:
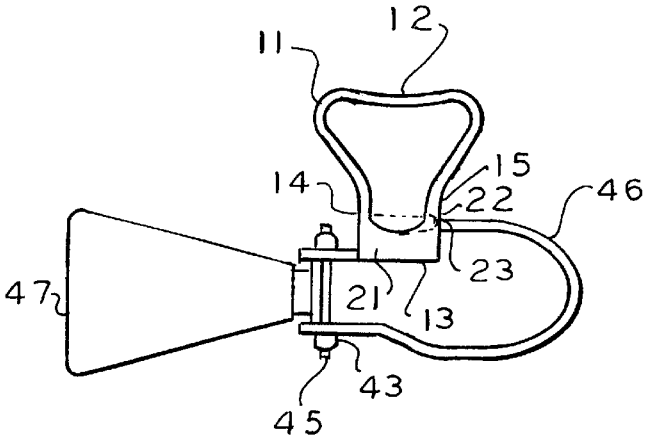
FIG. 9 is a top view of another embodiment of an earring stabilizer attached to a hinged clip through the use of a mount.

Referring to FIGS. 7–17, the earring stabilizer 10 may be cast, stamped, wire formed or manufactured separately from earring nut 31. In this case, the earring stabilizer 10 may be attached to the earring nut 31 or hinged clip 41 using a variety of attachment means and methods. For example, where gold is used, the earring stabilizer 10 should be ha rd soldered to earring nut 31 by hard soldering. Once these components are attached, they should be kiln hardened to return the spring action. However, silver cannot withstand hard soldering or kiln hardening. Therefore, where the components are silver, earring stabilizer 10 should be attached to earring nut 31 through other attachment means, including, soft solder with tin silver, adhesives (such as epoxy, glue, and cement), rivets, bolts, snaps, and other attachment means. It should be noted that these attachment means may be used for gold components as well. Where hinged clip 41 is used, the earring stabilizer 10 should be attached to the upper end of the hinged clip. However, some earrings are wide or large and may require that the hinged clip 41 be secured to the ear in a horizontal position. Referring to FIG. 9, the earring stabilizer 10 may be attached to other portions, such as the side of elongated member 46 of the hinged clip 41.

Figure 10:
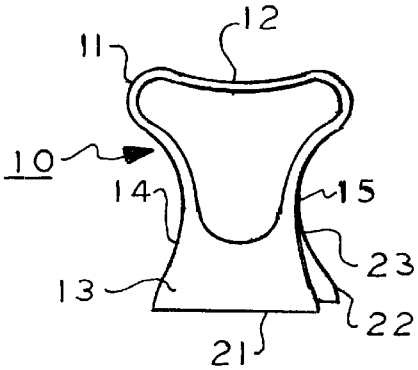
FIG. 10 is a front view of a first embodiment of a mount used in the present invention.
Figure 11:
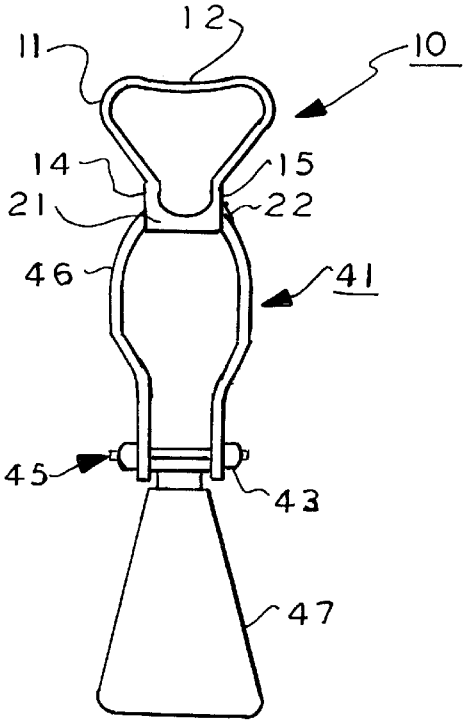
FIG. 11 is a front view of an earring stabilizer attached to a hinged clip through the use of the first embodiment of the mount.
Figure 12:
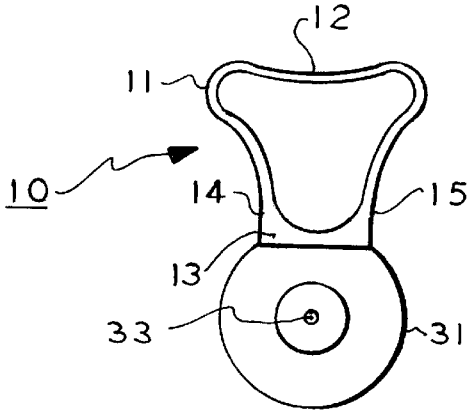
FIG. 12 is a front view of an earring stabilizer attached to an earring nut through the use of the first embodiment of the mount.
Figure 13:
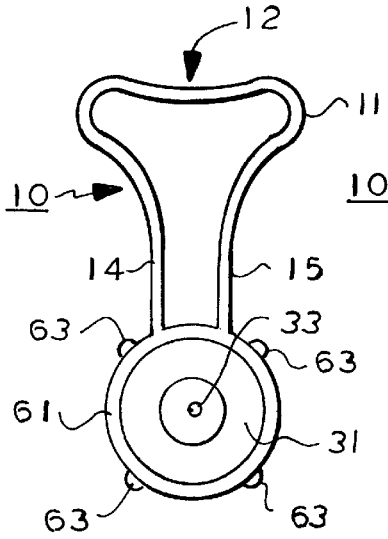
FIG. 13 is a front view of a second embodiment of the mount attached to an earring nut.
Figure 14:
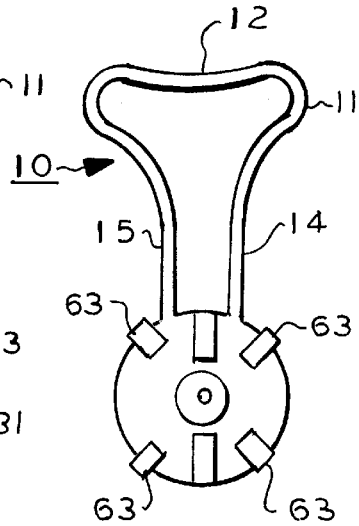
FIG. 14 is a rear view of a second embodiment of the mount attached to an earring nut.
Figure 15:
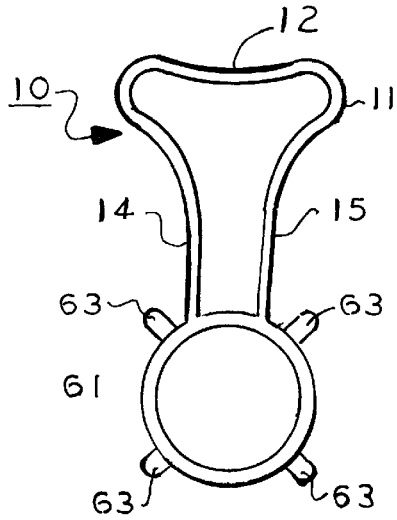
FIG. 15 is a front view of a second embodiment of the mount of the present invention.
Figure 16:
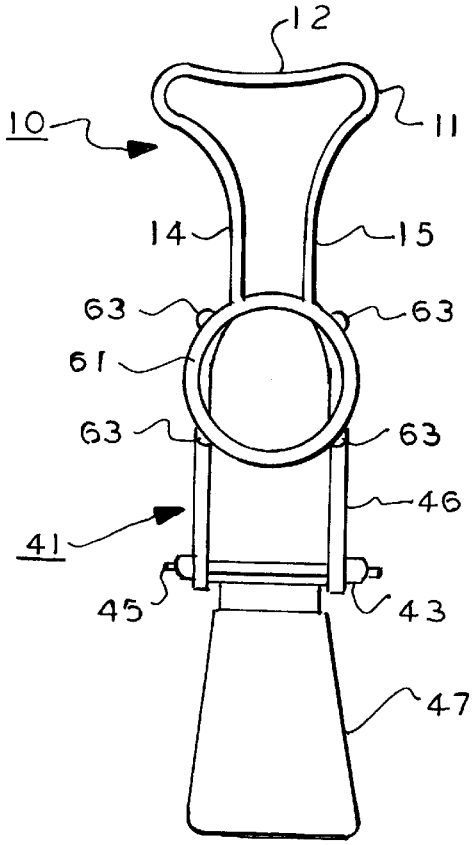
FIG. 16 is a front view of a second embodiment of the mount attached to a hinged clip.
Figure 17:
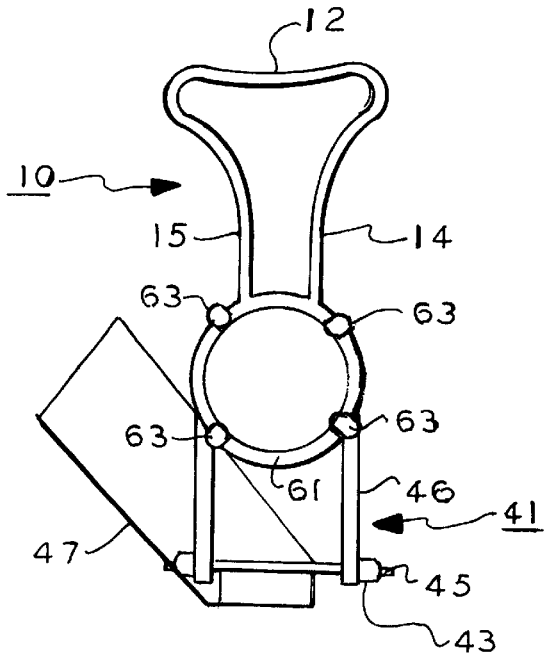
FIG 17 is a rear view of a second embodiment of the mount attached to a hinged clip.

The earring stabilizer may be attached to an earring retaining means through the use of mount 13. Referring to FIGS. 10–12, earring stabilizer 10 may be cast, stamped, wire formed or manufactured to include a mount 13. Preferably, Mount 13 should have arms 21 and 22, where the juncture of the arms 21 and 22 forms a notch 23. Arms 21 and 22 are preferably pliant. In mounting the stabilizer 10 on a retaining means, an edge or surface of the earring retaining means is inserted into notch 23. Arms 21 and 22 are moved into a position around the inserted edge or surface. In this embodiment, the mount 13 should be fixed to the retaining means through the use of the attachment means discussed herein.

It should be noted, however, that the design and structure of mount 13 may vary. Referring to FIGS. 13–17, the mount may consist of a circular member 61 having pliant prongs 63 attached to its outer edges. The circular member 61 should be fit securely around the earring retaining means to which it will be fixed. Where an earring nut 31 is used, circular member 61 should be approximately equal in size and shape to the earring nut 31. Where a hinged clip 41 is used, circular member 61 should be approximately equal in size and shape to the portion of the elongated member 46 to which it will be mounted. To fix mount 13 to either type of retaining means, circular member 61 should be placed on the inner surface 32 of earring retaining means. With the outer edges of the earring retaining means and circular member 61 aligned, prongs 63 should be riveted or bent around the edge of the retaining means and be secured to its outer surface. It should be noted, however, that the retaining means may be secured to the outer surface through means other than riveting, including but not limited to, screws, clamps, and snaps.

When wearing an earring having any of the retaining means discussed herein, the earring stabilizer 10 should be pressed firmly against the wearer's ear with the stabilizing member 11 facing in an upward, vertical direction.

In the foregoing description of the invention, reference to the drawings, certain terms have been used for conciseness, clarity, and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented, or described.

While the present invention has been described with reference to specific embodiments, it is understood that the invention is not so limited but rather includes any and all changes and modifications thereto which would be apparent to those skilled in the art and which come within the spirit and scope of the appended claims.

What is claimed is:

1. A stabilizer and an earring retainer having an opening therein for an earring, the stabilizer comprising:

a. a top;

b. a first extension bar having a first end and a second end, said first end of the first extension bar attached to a first portion of a mount member and the second end being attached to said top;

c. a second extension bar having a first end and a second end, said first end of said second extension bar attached to a second portion of the mount member and the second end being attached to said top;

d. the mount member including prongs, wherein said mount member is configured for being attached to the earring retainer.

2. The stabilizer and an earring retainer of claim 1, wherein:

said stabilizer is capable of contacting a wearer's ear and thereby prevent said earring from sagging on the wearer's ear.

3. The stabilizer for an earring retainer of claim 2, wherein side earring retainer is an earring nut.

4. The stabilizer and an earring retainer of claim 2, wherein said stabilizer comprises a shape configured to comfortably contact the wearer's ear that is capable of contacting said wearer's ear and thereby prevent sagging and improve support for heavy earrings.

5. The stabilizer and an earring retainer of claim 1, wherein said first extension bar and said second extension bar are connected to said earring retainer which is a hinged clip.

6. The stabilizer and an earring retainer of claim 1, wherein said earring retainer is an earring nut.

7. The stabilizer and an earring retainer of claim 1, wherein said mount member is a circular member, said pliant prongs being located on its edges.

8. The stabilizer and an earring retainer of claim 1, wherein said stabilizer is gold and said stabilizer is attached to said earring retainer through the use of hard soldering and kiln hardening.

9. The stabilizer and an earring retainer of claim 1, wherein said stabilizer is silver and said stabilizer is attached to said earring retainer through the use of soldering.

10. The stabilizer and an earring retainer of claim 1, where said stabilizer has a u-shape.

11. The stabilizer and an earring retainer of claim 1, wherein said stabilizer comprises a shape configured to comfortably contact the wearer's ear and is capable of contacting said wearer's ear and prevent sagging and improve support for heavy earrings.

12. A stabilizer for an earring, the stabilizer comprising:

a. a top;

b. an earring retaining means;

c. a first extension bar having a first end and a second end, said first end attached to a first portion of said earring retaining means and said second end being attached to said top;

d. a second extension bar having a first end and a second end, said first end of the second extension bar being attached to a second portion of said earring retaining means, and the second end of the second extension bar being attached to said top; and e. a stabilizing member being fixedly connected to said second end of said first extension bar, said second end of said second extension bar, and the earring retaining means.

13. The stabilizer for an earring of claim 12, wherein said earring retaining means is a hinged clip and said stabilizer is capable of contacting a wearer's ear and thereby prevent said earring from sagging on the wearer's ear.

14. The stabilizer for an earring of claim 12, wherein said earring retaining means is an earring nut and said stabilizer is capable of contacting a wearer's ear and thereby prevent said earring from sagging on the wearer's ear.

15. The stabilizer for an earring of claim 12, where the stabilizer has a u-shape.

16. The stabilizer for an earring of claim 12, wherein said stabilizer comprises a shape configured to comfortably contact the wearer's ear that is capable of contacting said wearer's ear and thereby prevent sagging and improve support for heavy earrings.

17. A stabilizer for an earring having an opening therein for an earring and for attachment to an earring retainer, the stabilizer comprising:

a. atop;

b. a first extension bar having a first end and a second end, said first end of the first extension bar attached to a first portion of an earring retainer and the second end being attached to said top; and c. a second extension bar having a first end and a second, said first end of said second extension bar attached to a second portion of the earring retainer and the second end being attached to said top, the stabilizer being fixedly connected to the earring retainer.

18. The stabilizer for an earring of claim 17, wherein the stabilizer is silver.

19. The stabilizer for an earring of claim 17, wherein the stabilizer is gold.

20. A stabilizer and an earring retainer having an opening therein for an earring, the stabilizer comprising:

a. a top;

b. a first extension bar having a first end and a second end, said first end of the first extension bar attached to a first portion of said earring retainer and the second end being attached to said top; and c. a second extension bar having a first end and a second, said first end of said second extension bar attached to a second portion of the earring retainer and the second end being attached to said top, the stabilizer is gold and is attached to the earring retainer through the use of hard soldering and kiln hardening.

* * * * *

UNITED STATES PATENT AND TRADEMARK OFFICE

CERTIFICATE OF CORRECTION

PATENT NO. : 6,571,579 B1
DATED : June 3, 2003
INVENTOR(S) : Joseph Rissin

It is certified that error appears in the above-identified patent and that said Letters Patent is hereby corrected as shown below:

Column 1,
Line 9, please replace “consist” with -- consists --.
Line 56, please replace “car” with -- ear --.

Column 2,
Line 47, please delete the word “only”.

Column 3,
Line 32, please delete the comma after “an”.
Line 49, please add -- separate -- after “wherein” but before “exten-”.

Column 5,
Line 24, please replace “ha rd” with -- hard --.
Line 46, please replace “Mount” with -- mount --.

Column 8,
Line 9, please replace “atop” with -- a top --.
Lines 14 and 30, please add -- end -- after “and a second”.

Signed and Sealed this

Nineteenth Day of July, 2005

JON W. DUDAS
*Director of the United States Patent and Trademark Office*